United States Patent [19]

Heirich

[11] 4,205,496

[45] * Jun. 3, 1980

[54] WALL PANELING SYSTEM

[76] Inventor: William C. Heirich, 2912 Wauhilah Dr., Muskogee, Okla. 74401

[ * ] Notice: The portion of the term of this patent subsequent to Jan. 20, 1993, has been disclaimed.

[21] Appl. No.: 591,861

[22] Filed: Jun. 30, 1975

Related U.S. Application Data

[63] Continuation of Ser. No. 439,754, Feb. 5, 1974, Pat. No. 3,932,968.

[51] Int. Cl.[2] ..... E04B 1/34; E04B 7/16; E04B 5/52

[52] U.S. Cl. ..... 52/74; 52/90; 52/478; 52/482; 52/588; 52/763; 52/777; 52/779

[58] Field of Search ..... 52/69, 73, 74, 75, 76, 52/77, 94, 90, 494, 496, 497, 492, 482, 588, 478

[56] References Cited

U.S. PATENT DOCUMENTS

| | | | |
|---|---|---|---|
| 2,848,765 | 8/1958 | Showalter | 52/74 |
| 3,084,479 | 4/1963 | Struben | 52/73 X |
| 3,107,401 | 10/1963 | Heirich | 52/73 X |
| 3,154,179 | 10/1964 | Harry | 52/497 X |
| 3,218,773 | 11/1965 | Heirich | 52/74 X |
| 3,300,941 | 1/1967 | Heirich | 52/74 X |
| 3,332,179 | 7/1967 | Toti | 52/478 X |
| 3,377,759 | 4/1968 | Booth | 52/90 X |
| 3,662,509 | 5/1972 | Studzinski | 52/478 X |

FOREIGN PATENT DOCUMENTS

| | | | |
|---|---|---|---|
| 1186192 | 1/1965 | Fed. Rep. of Germany | 52/497 |
| 2004112 | 8/1971 | Fed. Rep. of Germany | 52/497 |
| 1015974 | 1/1966 | United Kingdom | 52/478 |

*Primary Examiner*—Leslie Braun
*Attorney, Agent, or Firm*—Staas & Halsey

[57] ABSTRACT

A wall paneling system consisting of a strip horizontally secured to an abutment and provided with a continuous groove, a first support provided with a head positioned within the groove of the strip and configured so as to permit the first support when so installed to pivot about the groove of the strip, a plurality of bars secured in spaced relationship at their top ends to the first support, a second support to which the bottom ends of the bars are secured and which is provided with a continuous groove, a third support provided with a head positioned within the groove of the second support so as to permit rotation between the second and third supports, a second strip horizontally secured to an abutment, a first plurality of interlocking wall panels having flanges secured to adjacent bars of the plurality of bars, and a second plurality of panels secured between the third support and the second strip to form a ceiling.

4 Claims, 9 Drawing Figures

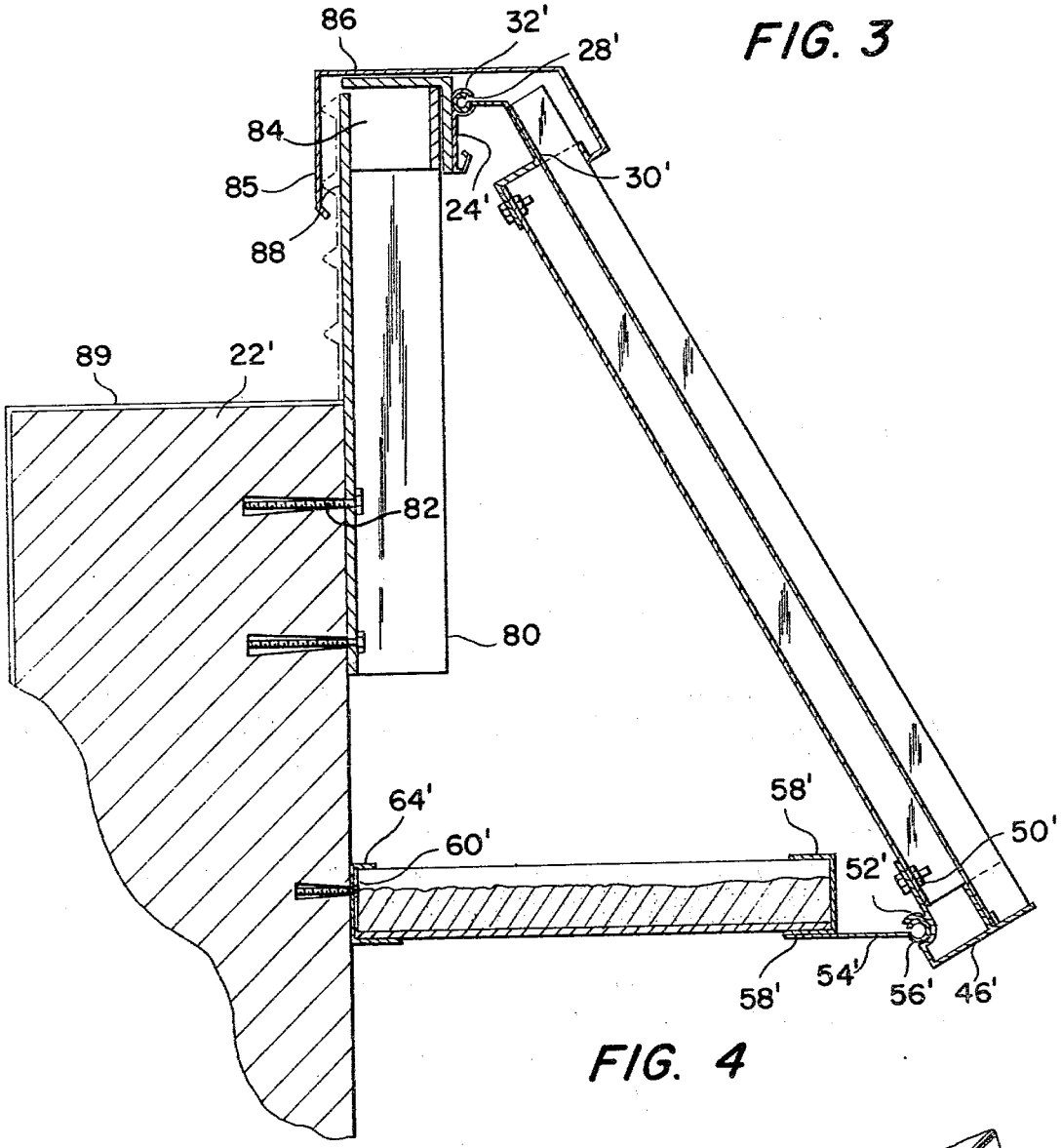
FIG. 3
FIG. 4
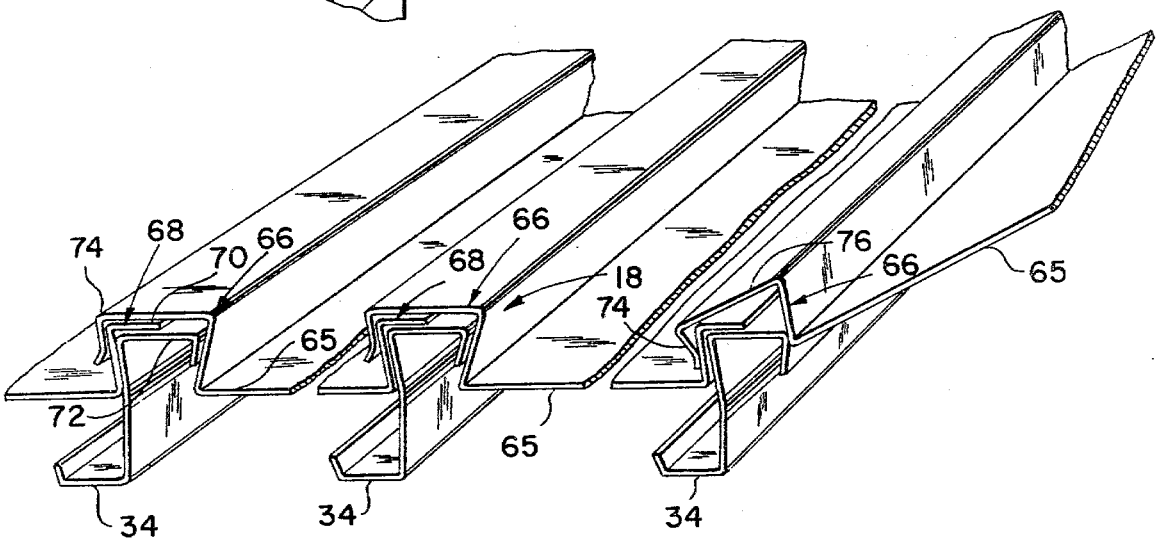

WALL PANELING SYSTEM

This is a continuation of application Ser. No. 439,754, filed Feb. 5, 1974, now U.S. Pat. No. 3,932,968.

BACKGROUND AND SUMMARY OF THE INVENTION

The present invention relates generally to wall paneling systems and in particular to a new concept in "Mansard" wall construction. While such construction is popular today in the building industry most prior art systems usually feature conventional construction techniques involving substantial improvising on the job site. It is generally true that such prior art construction requires that carpenters utilize conventional techniques to construct a framework over which the wall paneling is secured and under which a ceiling is provided. With the present invention, a "system" approach is taken to such construction featuring a combination of elements which are suitable for virtually all types and sizes of "Mansard" construction permitting the convenient ordering of entire systems and the efficient and low cost assembly of the components at the job site.

BRIEF DESCRIPTION OF THE DRAWINGS

FIG. 3 is a side elevational view partly in section illustrating a second embodiment particularly applicable where the top of the wall paneling system is to be attached at the roof line;

FIG. 4 is a cross sectional view of two adjacent panels positioned in locking relationship about adjacent Z-bars and a third panel just prior to being snapped securely in place about a third Z-bar;

FIG. 10 illustrates a hip mittered corner;

FIG. 11 illustrates a standard straight corner; and

FIG. 12 illustrates a standard mittered corner.

DESCRIPTION OF THE PREFERRED EMBODIMENT

Figure 1:
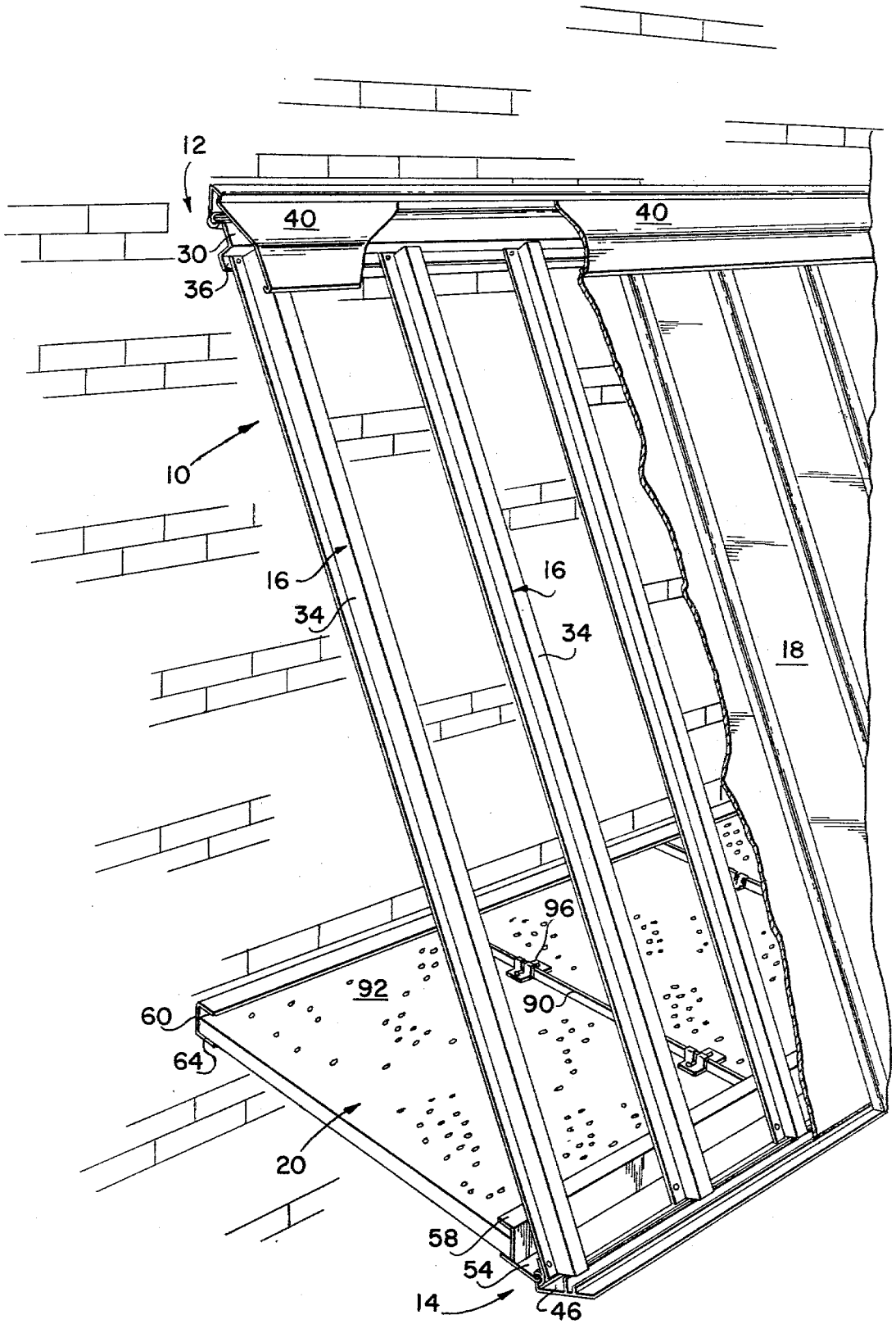
FIG. 1 is a perspective view broken at parts to illustrate the components of one embodiment of the present wall paneling system.

In FIG. 1, the reference numeral 10 designates generally the wall paneling system of the present invention which consists of a top hinge and flashing assembly 12, a bottom hinge and supporting assembly 14, a plurality of Z-bar assemblies 16 over which the wall paneling 18 is assembled, and a ceiling panel assembly 20.

Figure 2:
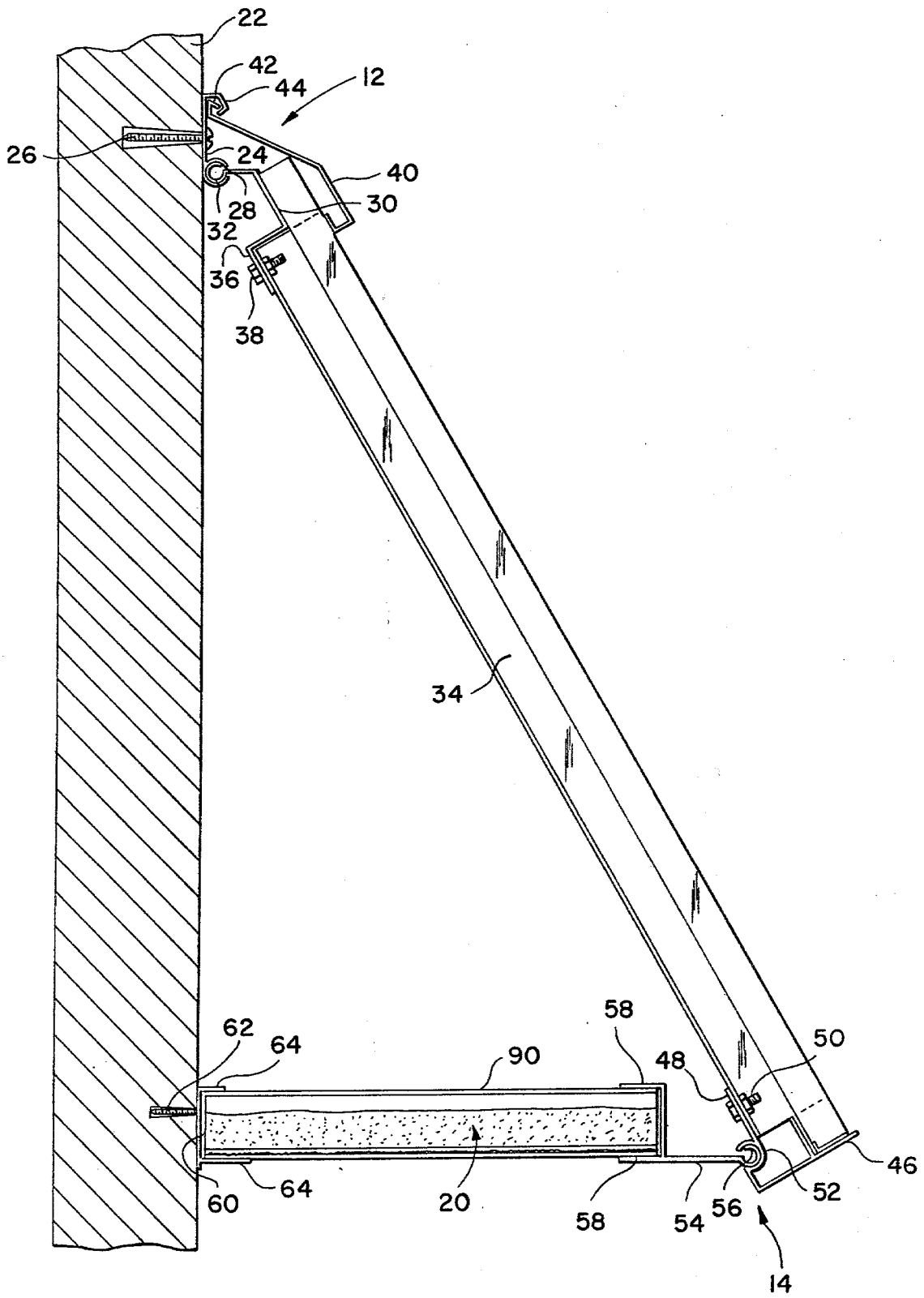
FIG. 2 is a side elevational view partly in section illustrating in particular the hinge assemblies located at both the top and bottom of the system permitting any desired degree of slope.
Figure 5:
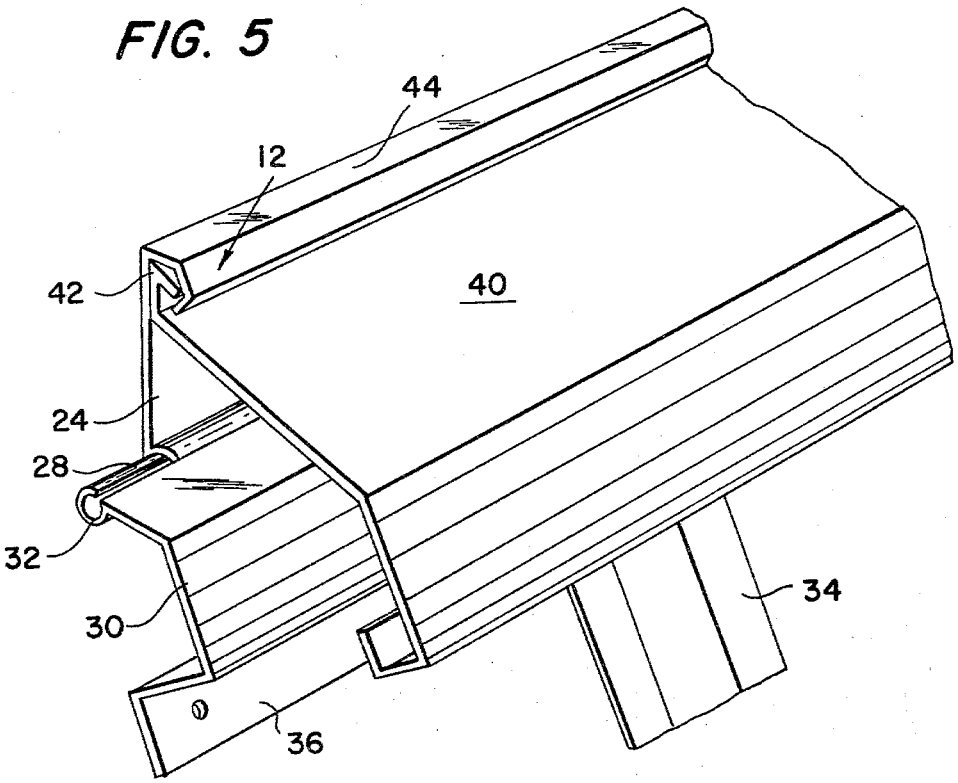
FIG. 5 is an enlarged perspective view illustrating the top hinge system and flashing.

Turning now to FIGS. 2 and 5, it will be noted that the reference numeral 22 designates a wall to which the top hinge and flashing assembly 12 is mounted. More particularly, the reference numeral 24 designates a strip which may be secured in any manner, for example, by fasteners 26, to the wall 22. Importantly, the strip 24 is provided with a groove 28 which is circular in cross section and which runs the entire length of the strip 24. A first support 30 is provided at the top thereof with a circular head 32 complementary in configuration with respect to the groove 28 of the strip 24. Thus, as the head 32 is inserted within the groove 28, it will be apparent that the first support 30 is free to rotate or pivot about the strip 24, the purpose of which will be explained in detail hereinafter.

Spaced along the first support 30, and secured thereto, are a plurality of Z-bars 34, the cross sectional shape thereof being illustrated in FIG. 4. As will be apparent from FIG. 2, each of the Z-bars 34 is secured to the bottom flange 36 of the first support 30 by bolts 38.

The final element of the top hinge and flashing assembly 12 consists of the flashing element 40 which is provided at the top thereof with a curved portion 42 arranged for engagement within the top curvilinear section 44 of the strip 24.

Figure 6:
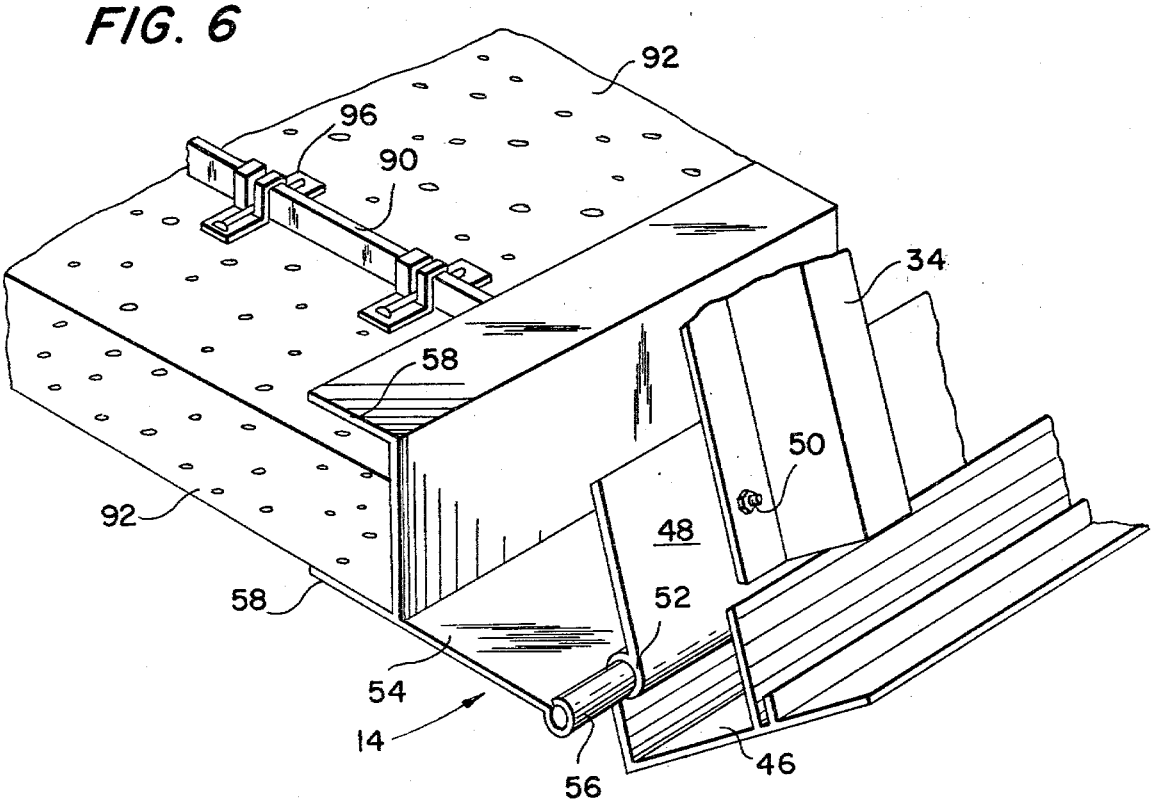
FIG. 6 is an enlarged perspective view illustrating the bottom hinge system and a part of the ceiling wall construction.

Turning now to the lower hinge system 14 as illustrated in FIGS. 2 and 6, it is noted that a second support 46 is provided with a flange 48 to which the bottom ends of the Z-bars 34 are secured by bolts 50. The second support 46 is further provided with a continuous groove 52 configured generally as the groove 28 of the strip 24. As will be apparent from FIG. 1, the second support 46 and the groove 52 thereof are horizontally positioned as are the strip 24 and groove 28.

A third support 54 is provided at one end thereof with a continuous head 56 being circular in cross section and corresponding generally to the head 32 of the first support 30. As will now be apparent, as the head 56 of the third support 54 is positioned within the groove 52 of the second support 46, relative rotation between the second and third supports 46 and 54 is possible, the purpose to be explained in detail hereinafter.

The third support 54 terminates inwardly in spaced flanges 58. Spaced from the third support 54 is a strip 60 suitably secured to the wall 22 by fasteners 62. The strip 60 is provided with spaced flanges 64 corresponding to the spaced flanges 58 of the third support 54.

The previously described top and bottom hinge systems 12 and 14 permit any desired slope while eliminating critical field measurement, it being apparent that these dual hinge systems are responsible for reducing substantially the installation cost of the present invention.

Figure 7:
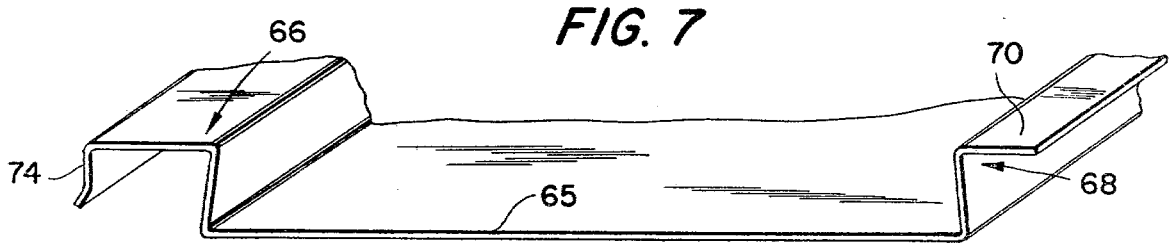
FIG. 7 is a cross sectional view of a single wall panel illustrating in particular the construction of the locking flanges thereof.
Figure 8:
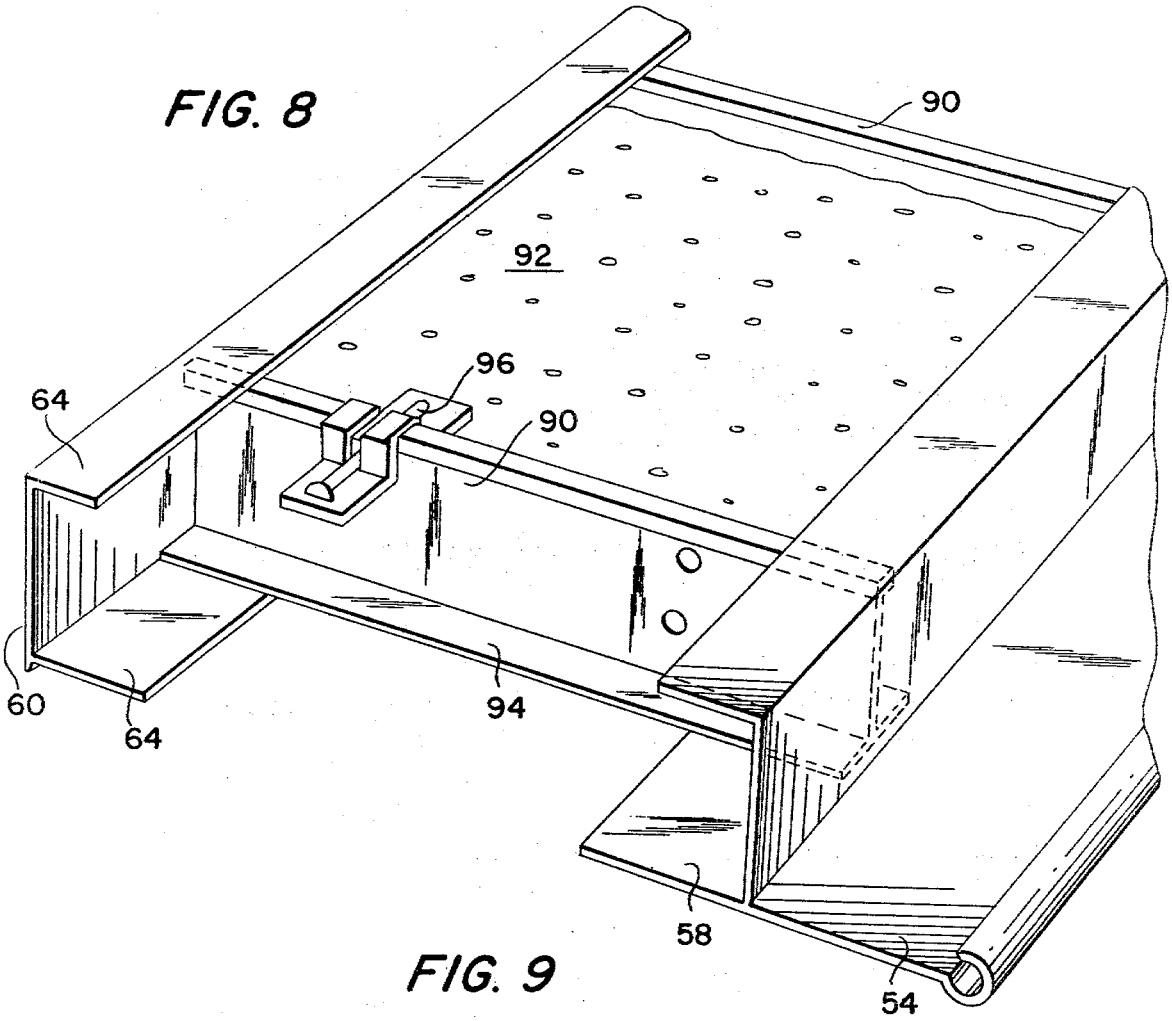
FIG. 8 is a perspective view illustrating construction of the ceiling panel assembly, and in particular the tee sections which are slidably mounted within the opposed flanges of the strip mounted to the wall and the lower hinge system, respectively, whereby the soffit panels may be sized as desired and inserted in place after which locking clips are used.

Turning now to FIGS. 4 and 7, it is apparent that the wall paneling 18 consists of individual panel elements 65 each provided at one end thereof with locking flange 66 and at the other end thereof with locking flange 68. The locking flanges 66 and 68 of adjacent panels 65 are secured to the Z-bars 34 as illustrated in detail in FIG. 4. In particular, as the flange 68 of a single panel 65 is positioned against one of the Z-bars 34 such that the top ledge 70 thereof abuts the top surface 72 of the Z-bar 34, it is then possible to position the curvilinear arm 74 of the locking flange 66 of an adjacent panel 65 against the already positioned flange 68, as illustrated in the right-hand portion of FIG. 4, and thereafter simply snap the flange 66 in place such that the top surface 76 thereof abuts the ledge 70 of the flange 68.

It will be apparent that because of the interlocking flanges 66 and 68, it is possible to form the wall 18 merely by snapping in place each individual panel 65. Moreover, separate fasteners which would not only mar the appearance of the assembled wall 18 but which would also create leakage problems are not necessary.

Where it is desired to secure the wall paneling system to the roof line, the construction of the top hinge and flashing assembly is different, as will now be described with reference to FIG. 3. The reference numeral 22' is used to designate the roof to which an angle brace 80 is secured with fasteners 82. At the top of the angle brace 80 is located a clip 84 provided at the side thereof with a strip 24' having a groove 28' formed in the side thereof. As will be apparent from comparing FIGS. 2 and 3, the strip 24' with the groove 28' is substantially the upside down version of the strip 24 and groove 28 illustrated in the FIG. 2 embodiment. As will also be apparent, a first support 30' is provided having at the top thereof a head 32' which is identical in construction to the support 30 as illustrated in FIG. 2. The embodiment of FIG. 3 also includes second and third supports 46' and 54' identical in construction to the supports 46 and 54 illustrated in FIG. 2. Finally, it will be apparent that in the FIG. 3 embodiment the reference numeral 86 designates the flashing which extends beyond the angle brace 80 covering the top part of a corrugated sheet 88. The flashing 89 covers the top of the wall 22' as further illustrated. Finally, while the construction of the top hinge and flashing assembly of the embodiment of FIG. 3 differs somewhat from the embodiment disclosed in FIG. 2, it will be readily apparent that the advantages resulting from the use of top and bottom hinge assemblies are present in both embodiments.

Turning now to FIGS. 1, 2, 6 and 8, it is apparent that the ceiling panel assembly 20 consists of a plurality of tees 90 arranged for sliding engagement within the opposed flanges 58 of the third support 54 and the opposed flanges 64 of the second strip 60. The ceiling panel assembly 20 is constructed by cutting the tees 90 to their desired length and thereafter inserting same within the opposed flange assemblies of the third support 54 and the strip 60. Then, the individual soffit panels 92 which, as preferred, are expanded polystyrene cores finished on both sides with textured stucco white acrylic, are inserted between adjacent tees 90 such that the bottom edges of each of the panels 92 rests upon and is supported by the bottom legs 94 of the tees 90 and the bottom flanges 58 and 64. Thereafter, clips 96 are inserted in place over the tops of the tees 90 so as to fixedly secure the soffit panels 92 in place.

Figure 9:
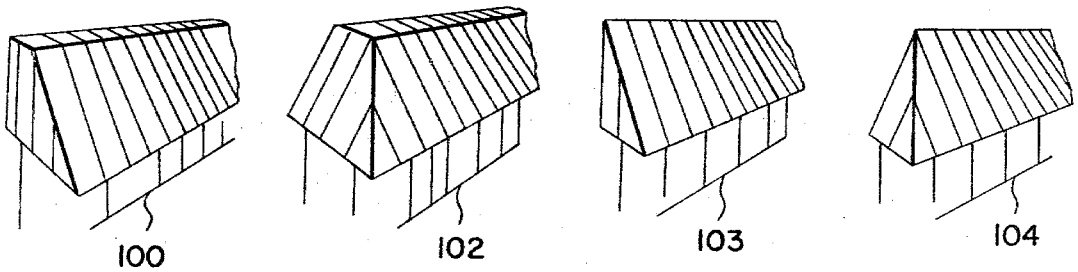
FIG. 9 illustrates a hip straight corner available for use with the wall paneling system of the present invention.

Remaining for consideration is a brief discussion of the corner constructions which are available for use with the wall paneling system of the present invention. In FIG. 9 there is disclosed a hip straight corner 100, in FIG. 9 there is disclosed a hip straight corner 100, in FIG. 10 a hip mittered corner 102, in FIG. 11 a standard straight corner 103 and in FIG. 12 a standard mittered corner 104. It will be apparent that to form such corners, it is necessary to employ items such as special trim for the panels and ceiling adaptors to be riveted to the trim for purposes of supporting the ceiling tees. Likewise, it is necessary to cut the Mansard panel and to fit the particular job after which the trim may be riveted to the panel. The details of finishing corners are not considered a part of the invention disclosed herein and will not be described further.

I claim:

1. A paneling system, comprising an upper support, a lower support, a plurality of bars, each bar comprising a top supporting wall, a first side wall sloping downwardly from said top supporting wall, a second side wall sloping downwardly from said top supporting wall and extending beyond the end of said first side wall, a central wall extending downwardly from said second side wall and terminating in a flange section disposed perpendicular thereto, those portions of said perpendicular flange of each of said bars positioned ajacent said upper and lower supports being attached to said upper and lower supports, and the plurality of panels locked to each other and to said bars, each of said panels comprising a midportion terminating at each end thereof in first and second locking portions, said first locking portion comprising a top supporting wall resting in abutting relationship against said top supporting wall of one of said bars and extending approximately one-half of the length across said top supporting wall and a downwardly sloping side wall resting in abutting relationship against said second side wall of one of said bars, said second locking portion comprising a top supporting wall resting in abutting relationship against said top supporting wall of one of said bars and extending approximately one-half of the length across said top supporting wall and a downwardly sloping side wall resting in abutting relationship against said second side wall of one of said bars, said second locking portion comprising a top supporting wall resting in abutting relationship against said top supporting wall of an adjacent of one of said first locking flanges and extending across the entire length of said top supporting wall of one of said bars, a first side wall abutting said side wall of one of said bars and extending downwardly therefrom and a second side wall abutting said side wall of an ajacent of one of said first locking portions, and wherein said panels are constructed of a flexible material.

2. A paneling system, comprising:

a plurality of bars, means securing said bars in spaced relationship with respect to each other, each of said bars being provided with a top supporting wall that is flat and which has substantially all portions thereof lying in a single plane and inwardly sloping side walls depending therefrom; and a plurality of panels secured to and connecting said bars, adjacent of said panels including a first flange provided with a flat supporting wall abutting said flat supporting wall of the adjacent of said bars and an inwardly sloping side wall depending therefrom abutting one of said inwardly sloping side walls of the adjacent of said bars, and a second flange provided with a flat supporting wall abutting said supporting wall of said one panel and inwardly sloping side walls depending therefrom abutting said inwardly sloping side wall of said one panel and the other of said inwardly sloping side walls of the adjacent of said bars, said panels being constructed of a flexible material permitting said side walls thereof to be bent enabling said flanges to be snapped in place with respect to each other.

3. A paneling system to be suspended from a wall, comprising:

a first support, means securing said first support to the wall;

a plurality of bars, means securing the top ends of said bars to said first support in such manner that said top ends are spaced apart from each other and extend continuously along said first support, each of said bars being provided with a top supporting wall that is flat and which has substantially all portions thereof lying in a single plane and inwardly sloping side walls depending therefrom;

a second support, means securing the bottom ends of said bars to said second support in such manner that said bottom ends are spaced apart from each other and extend continuously along said second support;

a plurality of panels secured to and connecting said first bars, adjacent of said panels including one flange provided with a flat supporting wall abutting said flat supporting wall of the adjacent of said bars and an inwardly sloping side wall depending therefrom abutting one of said inwardly sloping side walls of the adjacent of said bars, and another flange provided with a flat supporting wall abutting said supporting wall of said one panel and inwardly sloping side walls depending therefrom abutting said inwardly sloping side wall of said one panel and the other of said inwardly sloping side walls of the adjacent of said bars; and means suspending said second support from the wall.

4. A paneling system as in claim 3, wherein each of said bars further comprises a bottom wall formed as a continuation of one of said inwardly sloping side walls and including a portion thereof which is located substantially parallel to said top supporting wall and on the opposite side of said one of said inwardly sloping side walls from said top supporting wall.

* * * * *